US010024285B2

(12) United States Patent
Schuerz

(10) Patent No.: US 10,024,285 B2
(45) Date of Patent: Jul. 17, 2018

(54) PIEZO INJECTOR WITH HYDRAULICALLY COUPLED NOZZLE NEEDLE MOVEMENT

(71) Applicant: Continental Automotive GmbH, Hannover (DE)

(72) Inventor: Willibald Schuerz, Pielenhofen (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 767 days.

(21) Appl. No.: 14/415,332

(22) PCT Filed: Jul. 4, 2013

(86) PCT No.: PCT/EP2013/064111
§ 371 (c)(1),
(2) Date: Jan. 16, 2015

(87) PCT Pub. No.: WO2014/012795
PCT Pub. Date: Jan. 23, 2014

(65) Prior Publication Data

US 2015/0184627 A1 Jul. 2, 2015

(30) Foreign Application Priority Data

Jul. 18, 2012 (DE) ..... 10 2012 212 614

(51) Int. Cl.
*F02M 51/00* (2006.01)
*F02M 51/06* (2006.01)
(Continued)

(52) U.S. Cl.
CPC ..... *F02M 51/0603* (2013.01); *F02M 61/167* (2013.01); *F02M 63/0026* (2013.01);
(Continued)

(58) Field of Classification Search
CPC ..... F02M 47/027; F02M 63/0026; F02M 51/0603; F02M 21/0254; F02D 41/2096
(Continued)

(56) References Cited

U.S. PATENT DOCUMENTS 6,196,472 B1 3/2001 Cooke ..... 239/88
6,427,968 B1 8/2002 Stoecklein ..... 251/57
(Continued)

FOREIGN PATENT DOCUMENTS

AT 500889 A1 4/2006 ..... F02M 47/02
CN 1712696 A 12/2005 ..... F02M 61/16
(Continued)

OTHER PUBLICATIONS

Chinese Office Action, Application No. 201380063761.5, 12 pages, daed Oct. 8, 2016.
(Continued)

*Primary Examiner* — Marguerite McMahon
*Assistant Examiner* — James Kim
(74) *Attorney, Agent, or Firm* — Slayden Grubert Beard PLLC

(57) ABSTRACT

A piezo injector includes a piezo actuator arranged in an actuator chamber and a valve plunger arranged in a valve plunger bore and having a first end face facing the piezo actuator. The valve plunger is arranged between a first control chamber defined by a valve plunger bore portion delimited by the first end face and a spring chamber formed by a valve plunger bore portion opposite the first control chamber. A second control chamber is delimited by a second face of a nozzle needle and a sleeve guided by the nozzle needle. A leakage pin is arranged in a leakage pin bore between the piezo actuator and the first end face of the valve plunger. The leakage pin bore is formed in an intermediate plate arranged on a side of a control plate facing the piezo
(Continued)

actuator, the valve plunger bore being formed in said control plate.

16 Claims, 2 Drawing Sheets

(51) Int. Cl.
*F02M 63/00* (2006.01)
*F02M 61/16* (2006.01)

(52) U.S. Cl.
CPC ... *F02M 2200/28* (2013.01); *F02M 2200/703* (2013.01); *F02M 2200/704* (2013.01); *F02M 2547/001* (2013.01)

(58) Field of Classification Search
USPC ..... 123/478; 239/102.2, 533.2, 88
See application file for complete search history.

(56) References Cited

U.S. PATENT DOCUMENTS

| | | | | |
|---|---|---|---|---|
| 6,581,900 | B1 | 6/2003 | Stoecklein | 251/57 |
| 7,118,046 | B2 * | 10/2006 | Yoshimura | F02M 47/027 239/96 |
| 7,216,815 | B2 * | 5/2007 | Magel | F02M 47/027 123/446 |
| 7,258,283 | B2 | 8/2007 | Heinz et al. | 239/88 |
| 7,309,027 | B2 * | 12/2007 | Magel | F02M 51/0603 239/102.2 |
| 7,455,244 | B2 * | 11/2008 | Boecking | F02M 51/0603 239/102.2 |
| 7,926,737 | B2 | 4/2011 | Stoecklein et al. | 239/96 |
| 8,875,566 | B2 | 11/2014 | Hoffmann et al. | 73/114.45 |
| 9,121,378 | B2 | 9/2015 | Katzenberger et al. | |
| 9,133,805 | B2 | 9/2015 | Uhlmann | |
| 2004/0144868 | A1 * | 7/2004 | Yoshimura | F02M 47/027 239/533.2 |
| 2006/0032940 | A1 | 2/2006 | Boecking | 239/88 |
| 2006/0186221 | A1 | 8/2006 | Heinz et al. | 239/88 |
| 2006/0289681 | A1 * | 12/2006 | Boecking | F02M 45/086 239/533.3 |
| 2007/0261673 | A1 * | 11/2007 | Rueckle | F02M 47/027 123/445 |
| 2008/0053410 | A1 | 3/2008 | Gant | 123/472 |
| 2009/0065614 | A1 | 3/2009 | Ganser | 239/584 |
| 2009/0205614 | A1 | 8/2009 | Hlousek et al. | 123/476 |
| 2009/0266340 | A1 * | 10/2009 | Eisenmenger | F02M 47/027 123/494 |
| 2010/0038457 | A1 | 2/2010 | Yurtseven | 239/533.9 |
| 2012/0152206 | A1 | 6/2012 | Adachi et al. | 123/445 |
| 2014/0251276 | A1 | 9/2014 | Schürz | 123/456 |
| 2015/0184627 | A1 | 7/2015 | Schuerz | |
| 2015/0292462 | A1 | 10/2015 | Jagani et al. | 239/102.2 |

FOREIGN PATENT DOCUMENTS

| | | | | |
|---|---|---|---|---|
| CN | 101331312 | A | 12/2008 | F02M 47/02 |
| CN | 102483018 | A | 5/2012 | F02M 47/02 |
| DE | 10326045 | A1 | 12/2004 | F02M 45/08 |
| DE | 10326046 | A1 | 12/2004 | F02M 47/00 |
| DE | 102004054589 | A1 | 5/2006 | F02M 47/00 |
| DE | 102005030137 | A1 | 1/2007 | F02M 51/06 |
| DE | 102006011293 | A1 | 9/2007 | H01L 41/083 |
| DE | 102007006941 | A1 | 8/2008 | F02M 47/02 |
| DE | 102007051554 | A1 | 4/2009 | F02M 47/02 |
| DE | 102008002416 | A1 | 12/2009 | F02M 51/06 |
| DE | 102009002554 | A1 | 1/2010 | F02M 47/02 |
| DE | 102009039647 | A1 | 3/2011 | F02M 47/02 |
| DE | 102011056406 | A1 | 6/2012 | F02M 47/02 |
| DE | 102011003443 | A1 | 8/2012 | F02M 51/06 |
| EP | 0477400 | A1 | 4/1992 | F02M 51/06 |
| EP | 1433952 | A2 | 6/2004 | F02M 47/00 |
| EP | 1508690 | A1 | 2/2005 | F02M 51/06 |
| EP | 1508690 | B1 | 10/2006 | F02M 51/06 |
| EP | 1840366 | A2 | 10/2007 | F02M 51/06 |
| EP | 1983186 | A2 | 10/2008 | F02M 47/02 |
| EP | 2511514 | A2 | 10/2012 | F02M 47/02 |
| GB | 2296940 | A | 7/1996 | F02M 21/02 |
| WO | 01/23741 | A1 | 4/2001 | F02M 45/04 |
| WO | 2003/064847 | A1 | 8/2003 | F02M 51/06 |
| WO | 2005/019637 | A1 | 3/2005 | F02M 45/08 |
| WO | 2005/075811 | A1 | 8/2005 | F02M 51/06 |
| WO | 2007/098621 | A1 | 9/2007 | F02M 47/02 |
| WO | 2012/113796 | A1 | 8/2012 | F02D 41/20 |
| WO | 2012/126736 | A1 | 9/2012 | F02D 41/20 |
| WO | 2013/010929 | A1 | 1/2013 | F02M 51/06 |
| WO | 2014/012795 | A1 | 1/2014 | F02M 61/16 |
| WO | 2014/086933 | A1 | 6/2014 | F02M 47/02 |
| WO | 2014/095910 | A1 | 6/2014 | F02M 51/06 |

OTHER PUBLICATIONS

U.S. Final Office Action, U.S. Appl. No. 14/649,997, 16 pages, dated Dec. 2, 2016.
U.S. Advisory Action, U.S. Appl. No. 14/234,039, 3 pages, dated Nov. 4, 2016.
U.S. Final Office Action, U.S. Appl. No. 14/653,334, 13 pages, dated Nov. 4, 2016.
U.S. Final Office Action, U.S. Appl. No. 14/234,039, 15 pages, dated Jul. 1, 2016.
International Search Report and Preliminary Report on Patentability, Application No. PCT/EP2012/063753, 9 pages, dated Dec. 12, 2012.
International Search Report and Written Opinion, Application No. PCT/EP2013/076961, 18 pages, dated Mar. 28, 2014.
International Search Report and Written Opinion, Application No. PCT/EP2013/075693, 17 pages, dated Apr. 3, 2014.
U.S. Non-Final Office Action, U.S. Appl. No. 14/234,039, 16 pages, dated Jan. 15, 2016.
U.S. Non-Final Office Action, U.S. Appl. No. 14/649,997, 12 pages, dated Apr. 7, 2016.
U.S. Non-Final Office Action, U.S. Appl. No. 14/653,334, 10 pages, dated May 20, 2016.
U.S. Non-Final Office Action, U.S. Appl. No. 14/234,039, 32 pages, dated Feb. 9, 2017.
U.S. Non-Final Office Action, U.S. Appl. No. 14/653,334, 16 pages, dated Dec. 23, 2016.
Chinese Office Action, Application No. 201380062531.7, 14 pages, dated Oct. 8, 2016.
U.S. Non-Final Office Action, U.S. Appl. No. 14/649,997, 17 pages, dated Jun. 23, 2017.
U.S. Final Office Action, U.S. Appl. No. 14/234,039, 23 pages, dated Aug. 10, 2017.
International Search Report and Written Opinion, Application No. PCT/EP2013/064111, 15 pages, dated Sep. 9, 2013.
U.S. Non-Final Office Action, U.S. Appl. No. 14/234,039, 19 pages, dated Jan. 12, 2018.

* cited by examiner

PIEZO INJECTOR WITH HYDRAULICALLY COUPLED NOZZLE NEEDLE MOVEMENT

CROSS-REFERENCE TO RELATED APPLICATIONS

This application is a U.S. National Stage Application of International Application No. PCT/EP2013/064111 filed Jul. 4, 2013, which designates the United States of America, and claims priority to DE Application No. 10 2012 212 614.7 filed Jul. 18, 2012, the contents of which are hereby incorporated by reference in their entirety.

TECHNICAL FIELD

The invention relates to a piezo injector, e.g., for a fuel injector of an internal combustion engine.

BACKGROUND

Internal combustion engines with direct fuel injection are known. Piezo injectors, the nozzle needle of which is driven by a piezo actuator, are used for the direct fuel injection. Here a coupling virtually free of play is required between the piezo actuator and the nozzle needle, but this coupling is difficult to maintain due to thermally induced variations in length in the piezo injector. Insufficient play between the piezo actuator and the nozzle needle may result in incomplete closure of a nozzle needle. Excessive play between the piezo actuator and the nozzle needle may lead to an increase in the actuation energy needed to actuate the piezo injector. In the state of the art attempts have been made to compensate for thermally induced variations in length through a suitable choice of materials and geometry. This leads to high production costs, however, and severely restricts the design freedom in designing the piezo injector.

SUMMARY

One embodiment provides a piezo injector having an actuator chamber in which a piezo actuator is arranged, a valve plunger bore in which a valve plunger is arranged, wherein the valve plunger has a first end face facing the piezo actuator, wherein a portion of the valve plunger bore defined by the first end face forms a first control chamber, wherein a portion of the valve plunger bore opposite the first control chamber forms a spring chamber, wherein the valve plunger is arranged between the first control chamber and the spring chamber, a nozzle needle with a second end face, wherein the nozzle needle guides a nozzle needle sleeve, wherein the nozzle needle sleeve and the second end face define a second control chamber, a connecting bore between the first control chamber and the second control chamber, and a leakage pin, which is arranged between the piezo actuator and the first end face of the valve plunger in a leakage pin bore, wherein the leakage pin bore is formed in an intermediate plate, which on the side facing the piezo actuator adjoins a control plate, in which control plate the valve plunger bore is formed.

In a further embodiment, a connection plate, which defines the second control chamber, is provided at the end of the control plate facing the nozzle needle.

In a further embodiment, the intermediate plate or/and the control plate or/and the leakage pin are produced from a hard metal.

In a further embodiment, the intermediate plate or/and the control plate or/and the leakage pin have a modulus of elasticity three times higher than that of steel.

In a further embodiment, the modulus of elasticity lies in the range from 500 GPa to 700 GPa.

In a further embodiment, a first leakage is allowed from the first control chamber, wherein a second leakage is allowed from the spring chamber into the first control chamber, wherein a third leakage is allowed from the high-pressure area into the second control chamber, wherein a sum of the second leakage and the third leakage is at least equal to the first leakage, wherein the sum of the second leakage and the third leakage is so low that with the nozzle needle opened an increase in pressure in the second control chamber, caused by the second leakage and the third leakage, does not lead to closure of the nozzle needle.

In a further embodiment, the piezo injector comprises a high-pressure bore, wherein the high-pressure bore is connected to the high-pressure area, wherein the high-pressure area is connected to the spring chamber.

In a further embodiment, a valve plunger spring, which acts upon the valve plunger with a force acting in the direction of the first control chamber, is arranged in the spring chamber.

In a further embodiment, the piezo injector comprises a nozzle spring, which acts upon the nozzle needle with a force directed away from the second control chamber.

In a further embodiment, a first mating play exists between the leakage pin and the leakage pin bore, wherein the first mating play allows the first leakage, wherein the first mating play is less than two 2 μm.

In a further embodiment, a third mating play exists between the nozzle needle and the nozzle needle sleeve, wherein the third mating play allows the third leakage, wherein the third mating play is between 2 μm and 4 μm.

In a further embodiment, a second mating play exists between the valve plunger and the valve plunger bore, wherein the second mating play allows the second leakage, wherein the second mating play is between 2 μm and 4 μm.

In a further embodiment, the valve plunger has a restriction bore running between the first control chamber and the spring chamber, wherein the restriction bore allows the second leakage.

In a further embodiment, the restriction bore is closed by the leakage pin when the leakage pin bears on the valve plunger.

In a further embodiment, a restrictor is arranged in the connecting bore between the first control chamber and the second control chamber.

In a further embodiment, the piezo actuator is a fully active piezo stack.

BRIEF DESCRIPTION OF THE DRAWINGS

Example embodiments of the invention are described in more detail below with reference to the drawings, in which.

DETAILED DESCRIPTION

Figure 1:
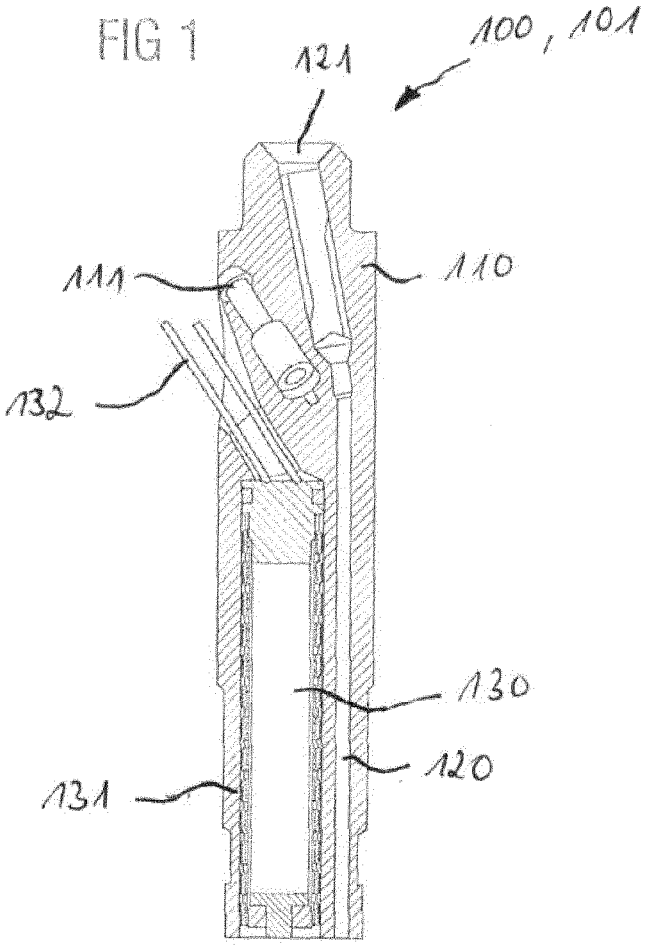
FIG. 1 shows a cross sectional view of an upper part of a piezo injector.

Embodiments of the present invention provide a piezo actuator in which variations in the length of the piezo injector are automatically compensated for.

Some embodiments provide a piezo injector comprising an actuator chamber in which a piezo actuator is arranged, a valve plunger bore in which a valve plunger is arranged, said valve plunger having a first end face facing the piezo actuator, wherein a portion of the valve plunger bore defined by the first end face forms a first control chamber, wherein a portion of the valve plunger bore opposite the first control chamber forms a spring chamber, and wherein the valve plunger is arranged between the first control chamber and the spring chamber, a nozzle needle with a second end face, wherein the nozzle needle guides a nozzle needle sleeve, wherein the nozzle needle sleeve and the second end face define a second control chamber, a connecting bore between the first control chamber and the second control chamber, and a leakage pin which is arranged between the piezo actuator and the first end face in a leakage pin bore. Here the leakage pin bore is formed in an intermediate plate, which on the side facing the piezo actuator adjoins a control plate, in which control plate the valve plunger bore is formed. In this piezo injector a hydraulic coupling advantageously exists between the piezo actuator and the nozzle needle. This hydraulic coupling advantageously compensates for play and transmits the lift. Variations in length in the piezo injector caused by temperature effects, wear at contact points in the drive and by variation of the state of polarization of the piezo actuator can thereby advantageously be compensated for. This advantageously allows the injector to be produced from any material without having to take account of thermal expansion characteristics of the material. It is therefore advantageously possible to use an especially high pressure-resistant material. Intricate adjustment processes for any play during assembly of the piezo injector are advantageously eliminated, which reduces the production costs of the piezo injector. The elimination of any play also reduces the energy needed for actuation of the piezo injector. A further advantage of the piezo injector lies in its improved injection quantity stability in dynamic engine operation. The fact that pressure losses in the piezo injector are reduced compared to the state of the art is likewise advantageous.

In a further embodiment a connection plate, which defines the second control chamber, is provided at the end of the control plate facing the nozzle needle.

Furthermore, in a further embodiment the intermediate plate or/and the control plate or/and the leakage pin are produced from a hard metal. Here the intermediate plate or/and the control plate or/and the leakage pin may have a modulus of elasticity three times higher than that of steel. According to the invention the modulus of elasticity may lie in the range from 500 to 700 GPa. This ensures that the bore for the leakage pin in the intermediate plate and the bore for the valve plunger are not inadmissibly constricted due to the fastening force exerted by the nozzle retaining nut (risk of jamming in the guides) and do not expand inadmissibly due to the effect of the high fuel pressure. Excessive expansion, particularly of the bore for the valve plunger, would make it impossible to keep the nozzle needle stably in the open position.

A first leakage is suitably allowed from the first control chamber, a second leakage from the spring chamber into the first control chamber and a third leakage from the high-pressure area into the second control chamber. Here a sum of the second leakage and the third leakage is at least equal to the first leakage. In addition, this sum of the second leakage and the third leakage is so low that with the nozzle needle opened an increase in pressure in the second control chamber, caused by the second leakage and the third leakage, does not lead to closure of the nozzle needle. The second leakage and the third leakage advantageously serve to prevent the first leakage causing an accidental opening of the nozzle needle. The second and third leakage advantageously also prevent an unwanted opening of the nozzle needle in the event of very sharp increases in pressure in the high-pressure area.

The piezo injector may comprise a high-pressure bore, which is connected to the high-pressure area. Here the high-pressure area is connected to the spring chamber. The high pressure of the high-pressure bore then advantageously always prevails in the spring chamber.

A valve plunger spring, which acts upon the valve plunger with a force acting in the direction of the first control chamber, is suitably arranged in the spring chamber. The valve plunger spring advantageously causes the valve plunger to return to its initial position once an injection sequence has been completed.

The piezo injector likewise suitably comprises a nozzle spring, which acts upon the nozzle needle with a force directed away from the second control chamber. The nozzle spring advantageously then assists the closure of the nozzle needle in order to terminate an injection sequence.

In one embodiment of the piezo injector a first mating play, which allows the first leakage, exists between the leakage pin and the leakage pin bore. Here the first mating play is less than two 2 μm. Experiments and model calculations have advantageously established that such a first mating play leads to a sufficiently small first leakage.

In one embodiment of the piezo injector a third mating play, which allows the third leakage, exists between the nozzle needle and the nozzle needle sleeve. Here the third mating play is between 2 μm and 4 μm. In model calculations and experiments it has advantageously emerged that a third mating play of this order of magnitude leads to a suitable third leakage.

In one embodiment of the piezo injector a second mating play, which allows the second leakage, exists between the valve plunger and the valve plunger bore. Here the second mating play is between 2 μm and 4 μm. Model calculations and experiments have advantageously shown that a second mating play of such dimensions leads to a second leakage of suitable magnitude.

In another embodiment of the piezo injector the valve plunger has a restriction bore running between the first control chamber and the spring chamber which allows the second leakage. Such a restriction bore also advantageously allows a second leakage of suitable magnitude.

In some embodiments the restriction bore is closed by the leakage pin when the leakage pin bears on the valve plunger. The second leakage is then advantageously interrupted when the nozzle needle is in the opened state, thereby reducing the risk of an unwanted closure of the nozzle needle caused by the second leakage.

In one embodiment of the piezo injector a restrictor is arranged in the connecting bore between the first and the second control chamber.

In some embodiments the piezo actuator is a fully active piezo stack. The piezo actuator may advantageously be hermetically separated from the fuel and therefore need not have resistance to the fuel.

Figure 2:
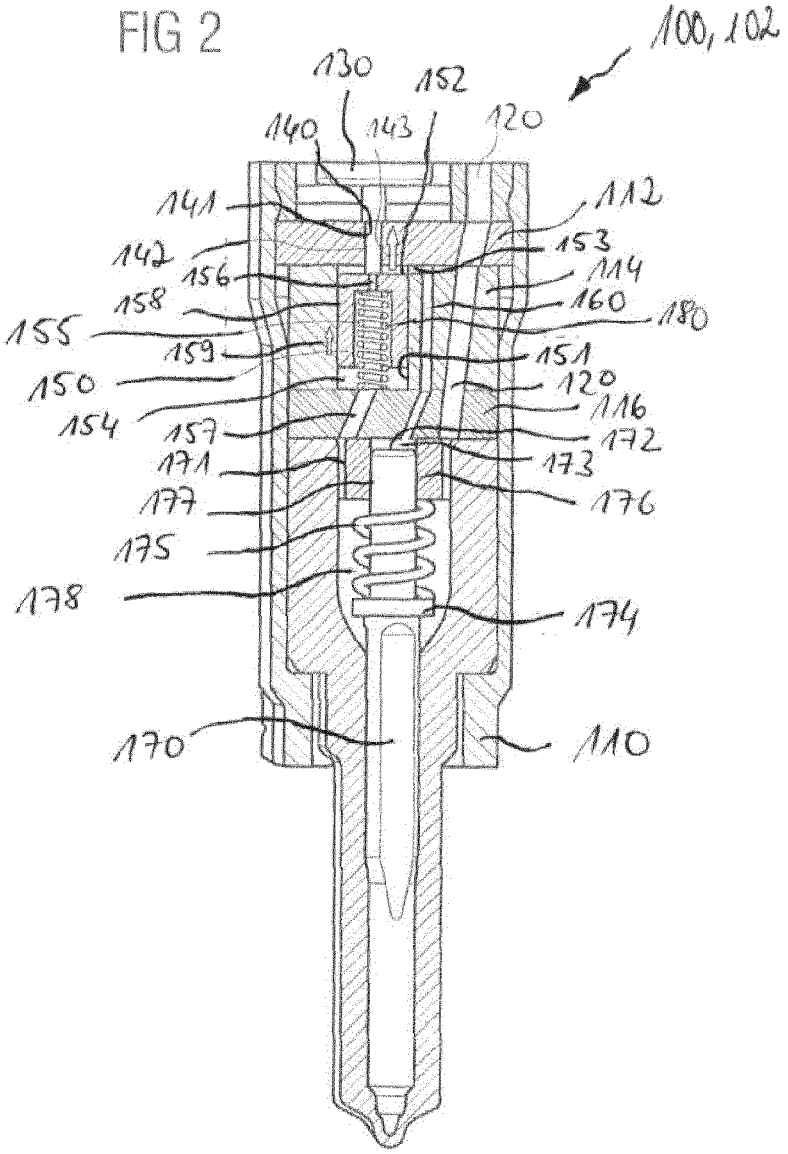
FIG. 2 shows a cross sectional view of a lower part of the piezo injector.

A cross sectional view of a piezo injector 100 is represented in FIGS. 1 and 2. FIG. 1 shows an upper part 101 of the piezo injector 100. FIG. 2 shows a lower part 102 of the piezo injector 100. The piezo injector 100 may serve for injecting fuel into an internal combustion engine. The piezo injector 100 may serve, for example, for injecting diesel fuel into a common-rail internal combustion engine. The piezo injector 100 has an injector housing 110.

The injector housing 110 may be composed of largely any material, since the thermal expansion characteristics of the injector housing 110 are insignificant. In particular, the injector housing 110 need not be composed of invar.

A high-pressure bore 120, to which fuel can be delivered under high pressure via a high-pressure connection 121, is arranged in the injector housing 110. The high-pressure bore 120 runs in a longitudinal direction through the injector housing 110, through an intermediate plate 112, a control plate 114 and a connection plate 116 to a high-pressure area 178, discussed in more detail below, in the lower part 102 of the piezo injector 100. The upper part 101 of the piezo injector 100 further comprises a leakage connection 111. In the upper part 101 of the piezo injector 100 the injector housing 110 further comprises an actuator chamber 131, in which a piezo actuator 130 is arranged. The piezo actuator 130 is preferably a fully active piezo stack. The piezo actuator 130 has an approximately cylindrical shape and by way of an electrical connection 132 can be subjected to an electrical voltage in order to vary the length of the piezo actuator 130 in a longitudinal direction.

In the lower part 102 the piezo injector 100 has a valve plunger bore 151, which is formed in the control plate 114. The valve plunger 150 is arranged in the valve plunger bore 151. The valve plunger 150 has a first end face 152 facing in the direction of the piezo actuator 130. A portion of the valve plunger bore 151 defined by the first end face 152 forms a first control chamber 153 in the control plate 114. At its opposite longitudinal end to the first control chamber 153 the valve plunger bore 151 forms a spring chamber 154, which is likewise arranged in the control plate 114. The valve plunger 150 is therefore arranged between the first control chamber 153 and the spring chamber 154. In addition the first control chamber 153 is defined by the intermediate plate 112, which is arranged on the side facing the piezo actuator adjoining the control plate 114.

A valve plunger spring 155, which may be embodied as a spiral pressure spring, for example, is situated in the spring chamber 154. A first longitudinal end of the valve plunger spring 155 is supported on the valve plunger 150. A second longitudinal end of the valve plunger spring 155 is supported on an end face of the valve plunger bore 151. The valve plunger spring 155 acts upon the valve plunger 150 with a force acting in the direction of the first control chamber 153.

The spring chamber 154 is connected to the high-pressure area 178 by a high-pressure connection 157. The high-pressure connection 157 is formed in the connection plate 116, which defines the spring chamber 154 on the side remote from the piezo actuator and adjoins the control plate 114. When the piezo actuator 100 is in operation, therefore, fuel is always present in the spring chamber 154 at the pressure prevailing in the high-pressure bore 120 and the high-pressure area 178.

A leakage pin 140 is arranged in a leakage pin bore 141 between the piezo actuator 130 and the valve plunger bore 151. This leakage pin bore 141 is formed in the intermediate plate 112. Here the length of the leakage pin 140 is dimensioned so that an increase in the length of the piezo actuator 130 is transmitted to the valve plunger 150 via the leakage pin 140. Also arranged in the lower part of the piezo injector is the high-pressure area 178, into which the high-pressure bore 120 opens. A nozzle needle 170, which guides a nozzle needle sleeve 171, is arranged in the high-pressure area 178. A longitudinal end of the nozzle needle 170 point the in the direction of the upper part 101 of the piezo injector 100 has a second end face 172. A second control chamber 173, which is defined by the second end face 172 of the nozzle needle 170, the nozzle needle sleeve 171 and the connection plate 116, is formed above the second end face 172. The second control chamber 173 is connected to the first control chamber 153 by a connecting bore 160. Wherein the connecting bore 160 runs through the control plate 114 and the connection plate 116.

The nozzle needle 170 has a circumferential collar 174 fixedly connected to the nozzle needle 170. A nozzle spring 175, which may be embodied as a spiral pressure spring, for example, is arranged between the collar 174 and the nozzle needle 171. A first longitudinal end of the nozzle spring 175 is supported on the nozzle needle sleeve 171. A second longitudinal end of the nozzle spring 175 is supported on the collar 174. The nozzle spring 175 acts upon the nozzle needle 170 with a force directed away towards the second control chamber 173.

With the piezo injector 100 in the closed state, the nozzle needle 170 bears on a lower tip of the lower part 102 of the piezo injector 100. The piezo actuator 130 is discharged and is at its minimum length. The piezo injector 100 does not perform any fuel injection.

If the piezo actuator 130 is charged via the electrical connection 132 so that the length of the piezo actuator 130 increases, the piezo actuator 130, via the leakage pin 140, exerts a force on the valve plunger 150 which causes the valve plunger 150 in the valve plunger bore 151 to move in the direction of the spring chamber 154. The volume of the first control chamber 153 thereby increases so that the pressure in the first control chamber and in the second control chamber 173 diminishes. The reduced pressure in the second control chamber 173 therefore exerts a now reduced force on the second end face 172 of the nozzle needle 170. The high pressure of the high-pressure area 178 continuing to act on the lower end of the nozzle needle then produces an upward movement of the nozzle needle 170 in the direction of the second control chamber 173. As a result the piezo injector 100 is opened and fuel is injected.

A transmission ratio between a variation in the length of the piezo actuator 130 and a lift of the nozzle needle 170 is defined by the ratio of the diameter of the valve plunger 150 and thereby the diameter of the first control chamber 153 to the diameter of the nozzle needle 170 at its second end face 172 and thereby the diameter of the second control chamber 173. If the diameter of the valve plunger 150 is 5 mm, for example, and the diameter of the nozzle needle 170 at its second end face 172 is 3.5 mm, for example, this gives a transmission ratio of approximately 2.

Once the nozzle needle 170 has opened, the lift of the nozzle needle 170 can be controlled by varying the length of the piezo actuator 130. The length of the piezo actuator 130 can in turn be varied by varying the energy fed to the piezo actuator 130 via the electrical connection 132. If the piezo actuator 130 is then discharged and thereby shortened, the pressure prevailing in the spring chamber 154 and the force exerted on the valve plunger 150 by the valve plunger spring 155 cause the valve plunger 150 to move in the direction of the first control chamber 153. This increases the pressure in the first control chamber 153 and, owing to the connecting bore 160 that exists between the first control chamber 153 and the second control chamber 173, also increases the pressure in the second control chamber 173. This results in a return movement of the nozzle needle 170 to the lower end of the lower part 102 of the piezo injector 100, closing the piezo injector 100 and terminating the fuel injection.

The spring force exerted on the valve plunger 150 by the valve plunger spring 154 ensures that with the piezo injector 100 in the closed state the valve plunger 150 always bears on the leakage pin 140 and the drive formed by the piezo actuator 130, the leakage pin 140 and the valve plunger 150 is always free of play. As a result changing thermal boundary conditions, variations in length of the piezo actuator 130 and wear phenomena in the contact areas do not have any noticeable influence on the injection quantities delivered by the piezo injector 100.

The leakage pin 140 is fitted into the leakage pin bore 141 with a first mating play 142. Owing to the first mating play 142 a first leakage 143 from the first control chamber 143 occurs along the leakage pin 140 into an area of the piezo injector 100 located above the leakage pin 140, from whence the first leakage 143 can escape via the leakage connection 111.

Owing to the high pressure prevailing in the first control chamber 153 the first mating play 142 selected must be small, in order to obtain a small first leakage 143. The first mating play 142 is preferably less than 2 μm, more preferably approximately 1 μm.

The valve plunger 150 is fitted into the valve plunger bore 151 with a second mating play 158. If the pressure in the first control chamber 153 is less than the pressure in the spring chamber 154, the second mating play 158 gives rise to a second leakage 159 from the spring chamber 154 along the valve plunger 150 into the first control chamber 153. The valve plunger 150 may also have a restriction bore 156, which runs from the spring chamber 154 through the valve plunger 150 to the first control chamber 153. In this case a fourth leakage 180 is possible from the spring chamber 154 into the first control chamber 153 through the restriction bore 156. In the absence of the restriction bore 156, the second mating play 158 is preferably between 3 μm and 10 μm, more preferably between 2 μm and 4 μm, in order to allow a sufficient second leakage 159. If the restriction bore 156 is present and the fourth leakage 180 is thereby possible, the second mating play 158 selected may be very small, amounting to 1 μm, for example.

The nozzle needle 170 is fitted into the nozzle needle sleeve 171 with a third mating play 176. If the pressure in the second control chamber 173 is less than the pressure in the high-pressure area 178, a third leakage 177 may occur along the nozzle spring 175 through the third mating play 176, from the high-pressure area 178 into the second control chamber 173. The third mating play 176 is preferably between 3 μm and 10 μm, more preferably between 2 μm and 4 μm. If the restriction bore 156 is present, the third leakage 177 may be dispensed with and the third mating play 176 may likewise be designed very small, for example in the order of approximately 1 μm. With the piezo injector in the closed state the first leakage 143 along the leakage pin 140 gives rise to a discharge of fuel from the first control chamber 153. In order that this discharge of fuel from the first control chamber 153 does not lead to a fall in pressure in the first control chamber 153, which might result in accidental opening of the nozzle needle 170, the fuel loss caused by the first leakage 153 must be compensated for by the second leakage 159, the third leakage 177 and/or the fourth leakage 180. In the absence of the restriction bore 156 and hence of the fourth leakage 180, the sum of the second leakage 159 and the third leakage 177 must be at last equal to the first leakage 143. If the restriction bore 156 is present, the sum of the second leakage 159, the third leakage 177 and the fourth leakage 180 must be at last equal to the first leakage 143.

With the nozzle needle 175 and hence the piezo injector 100 in the opened state, the second leakage 159, the third leakage 177 and/or the fourth leakage 180 give rise to a discharge of fuel into the first control chamber 153 and the second control chamber 173. The admission of fuel produces an increase in pressure in the first control chamber 133 and in the second control chamber 173. The increase in pressure, however, must be small enough to ensure that it does not result in accidental, premature closure of the nozzle needle 170 and thereby of the piezo injector 100.

The restriction bore 156 and the leakage pin 130 are more preferably designed so that the leakage pin 140 closes the restriction bore 156 when the nozzle needle 170 is opened. As a result, with the nozzle needle 170 opened the fourth leakage 180 is prevented, so that a premature, unwanted closure of the nozzle needle 170 is precluded.

A restrictor may be arranged in the connecting bore 160 between the first control chamber 153 and the second control chamber 173.

The second leakage 159 and the third leakage 177 are also necessary in order to prevent unwanted opening of the nozzle needle 170 in the event of very sharp rises in pressure in the high-pressure area 178.

The intermediate plate 112, control plate 114 and leakage pin 140 components may be produced from hard metal. An outstanding characteristic of such hard metals is that they have a modulus of elasticity three times higher than that of steel. The modulus of elasticity preferably lies in the range from 500 GPa to 700 GPa.

The intermediate plate 112 and the control plate 114 thereby afford a stable guide play for the leakage pin and the valve plunger over the entire operating range of the injector.

What is claimed is:

1. A piezo injector comprising:

an actuator chamber, a piezo actuator arranged in the actuator chamber, a valve plunger bore, a valve plunger arranged in the valve plunger bore, wherein the valve plunger has a first end face facing the piezo actuator, wherein a portion of the valve plunger bore defined by the first end face forms a first control chamber, wherein a portion of the valve plunger bore opposite the first control chamber forms a spring chamber, and wherein the valve plunger is arranged between the first control chamber and the spring chamber, a nozzle needle disposed in a high-pressure area and having a second end face, wherein the nozzle needle slides within a nozzle needle sleeve, wherein the nozzle needle sleeve and the second end face define a second control chamber, a connecting bore between the first control chamber and the second control chamber, a leakage pin bore formed in an intermediate plate between the actuator chamber and the valve plunger bore, and a leakage pin arranged in the leakage pin bore transmitting force between the piezo actuator and the first end face of the valve plunger.

2. The piezo injector of claim 1, comprising a connection plate at the end of the control plate facing the nozzle needle, the connection plate defining the second control chamber.

3. The piezo injector of claim 1, wherein at least one of the intermediate plate, the control plate, and the leakage pin is produced from a hard metal.

4. The piezo injector of claim 1, wherein at least one of the intermediate plate, the control plate, and the leakage pin has a modulus of elasticity three times higher than that of steel.

5. The piezo injector of claim 4, wherein the modulus of elasticity lies in the range from 500 GPa to 700 GPa.

6. The piezo injector of claim 1, wherein:

a first leakage is allowed from the first control chamber, a second leakage is allowed from the spring chamber into the first control chamber, a third leakage is allowed from the high-pressure area into the second control chamber, a sum of the second leakage and the third leakage is at least equal to the first leakage, and the sum of the second leakage and the third leakage remains below a threshold providing an increase in pressure in the second control chamber, caused by the second leakage and the third leakage, does not lead to closure of the nozzle needle if the nozzle needle is in an open state.

7. The piezo injector of claim 1, comprising a high-pressure bore connected to the high-pressure area, wherein the high-pressure area is connected to the spring chamber.

8. The piezo injector of claim 1, comprising a valve plunger spring arranged in the spring chamber, wherein the valve plunger spring acts on the valve plunger with a force acting in the direction of the first control chamber.

9. The piezo injector of claim 1, comprising a nozzle spring that acts on the nozzle needle with a force pushing the nozzle needle away from nozzle sleeve and the second control chamber.

10. The piezo injector of claim 1, wherein a mating play exists between the leakage pin and the leakage pin bore, wherein the mating play allows a leakage from the first control chamber, and wherein the mating play is less than two 2 μm.

11. The piezo injector of claim 1, wherein a mating play exists between the nozzle needle and the nozzle needle sleeve, wherein the mating play allows a leakage from the high-pressure area into the second control chamber, and wherein the mating play is between 2 μm and 4 μm.

12. The piezo injector of claim 11, wherein a mating play exists between the valve plunger and the valve plunger bore, wherein the mating play allows a leakage from the spring chamber into the first control chamber, and wherein the mating play is between 2 μm and 4 μm.

13. The piezo injector of claim 1, wherein the valve plunger has a restriction bore running between the first control chamber and the spring chamber, wherein the restriction bore allows a leakage from the spring chamber into the first control chamber.

14. The piezo injector of claim 13, wherein the restriction bore is closed by the leakage pin when the leakage pin bears on the valve plunger.

15. The piezo injector of claim 1, wherein the piezo actuator is a fully active piezo stack.

16. An internal combustion engine, comprising:

at least one piezo injector, each piezo injector comprising:

an actuator chamber, a piezo actuator arranged in the actuator chamber, a valve plunger bore, a valve plunger arranged in the valve plunger bore, wherein the valve plunger has a first end face facing the piezo actuator, wherein a portion of the valve plunger bore defined by the first end face forms a first control chamber, wherein a portion of the valve plunger bore opposite the first control chamber forms a spring chamber, and wherein the valve plunger is arranged between the first control chamber and the spring chamber, a nozzle needle with a second end face, wherein the nozzle needle slides within a nozzle needle sleeve, wherein the nozzle needle sleeve and the second end face define a second control chamber, a connecting bore between the first control chamber and the second control chamber, a leakage pin bore formed in an intermediate plate between the actuator chamber and the valve plunger bore, and a leakage pin arranged in the leakage pin bore transmitting force between the piezo actuator and the first end face of the valve plunger.

* * * * *